US011295705B2

(12) United States Patent
Zhang et al.

(10) Patent No.: US 11,295,705 B2
(45) Date of Patent: Apr. 5, 2022

(54) DISPLAY SCREEN BRIGHTNESS ADJUSTMENT METHOD AND APPARATUS

(71) Applicant: BEIJING XIAOMI MOBILE SOFTWARE CO., LTD., Beijing (CN)

(72) Inventors: Yuan Zhang, Beijing (CN); Haining Huang, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 3 days.

(21) Appl. No.: 17/016,081

(22) Filed: Sep. 9, 2020

(65) Prior Publication Data

US 2021/0287625 A1 Sep. 16, 2021

(30) Foreign Application Priority Data

Mar. 12, 2020 (CN) ..... 202010171574.0

(51) Int. Cl.
*G09G 5/10* (2006.01)

(52) U.S. Cl.
CPC ..... *G09G 5/10* (2013.01); *G09G 2320/0233* (2013.01); *G09G 2320/0247* (2013.01); *G09G 2320/0626* (2013.01)

(58) Field of Classification Search
CPC ..... G09G 5/10; G09G 2320/0233; G09G 2320/0247; G09G 2320/0626; G09G 3/3406; G09G 2320/0646; G09G 2320/0653; G09G 2360/16
See application file for complete search history.

(56) References Cited

U.S. PATENT DOCUMENTS

| | | | | |
|---|---|---|---|---|
| 10,242,635 | B2 * | 3/2019 | Nakaya | G09G 3/3648 |
| 11,132,976 | B2 * | 9/2021 | Kim | G09G 3/20 |
| 2009/0146941 | A1 | 6/2009 | Fujine et al. | |
| 2014/0055505 | A1 | 2/2014 | Ikeda et al. | |
| 2014/0092001 | A1 * | 4/2014 | Kikkawa | G09G 3/3426 345/102 |
| 2016/0027354 | A1 * | 1/2016 | Terai | G09G 3/006 345/87 |
| 2018/0040271 | A1 * | 2/2018 | Jung | G09G 3/2007 |
| 2020/0394982 | A1 | 12/2020 | Zhong et al. | |

FOREIGN PATENT DOCUMENTS

CN 110211548 A 9/2019

OTHER PUBLICATIONS

European Patent Office, Extended European Search Report Issued in Application No. 21155793.9, dated Jul. 20, 2021, Germany, 14 pages.

* cited by examiner

*Primary Examiner* — Rodney Amadiz
(74) *Attorney, Agent, or Firm* — Syncoda LLC; Feng Ma

(57) ABSTRACT

A method for adjusting brightness of a display screen includes: in response to a brightness adjustment trigger operation, determining a target brightness level of the display screen based on a current brightness level of the display screen; obtaining a corresponding physical brightness and a corresponding display coefficient based on the target brightness level, wherein the display coefficient is smaller than 1, and the physical brightness is included in a physical brightness range in high brightness mode of the display screen; and controlling the display screen to display at a target display brightness based on the obtained physical brightness and the obtained display coefficient.

16 Claims, 3 Drawing Sheets

DISPLAY SCREEN BRIGHTNESS ADJUSTMENT METHOD AND APPARATUS

CROSS-REFERENCE TO RELATED APPLICATION

This application claims priority to Chinese Patent Application No. 202010171574.0 filed on Mar. 12, 2020, the disclosure of which is hereby incorporated by reference in its entirety.

BACKGROUND

Brightness of a display screen of a terminal device can be adjusted, for example, manually by a user, or automatically based on brightness of the ambient light. In this way, the brightness of the display screen can be adapted to different application environments.

SUMMARY

The present disclosure relates generally to the technical field of display screen technologies, and more specifically to a method and an apparatus for adjusting brightness of a display screen, and a terminal device.

In a first aspect, an embodiment of the present disclosure provides a method of adjusting brightness of a display screen, including: in response to a brightness adjustment trigger operation, determining a target brightness level of the display screen based on a current brightness level of the display screen; obtaining a corresponding physical brightness and a corresponding display coefficient based on the target brightness level, wherein the display coefficient is smaller than 1, and the physical brightness is included in a physical brightness range in high brightness mode of the display screen; and controlling the display screen to display at a target display brightness based on the obtained physical brightness and the obtained display coefficient.

In a second aspect, an embodiment of the present disclosure provides an apparatus of adjusting brightness of a display screen, including: a determining module configured to, in response to a brightness adjustment trigger operation, determine a target brightness level of the display screen based on a current brightness level of the display screen; an obtaining module configured to obtain a corresponding physical brightness and a corresponding display coefficient based on the target brightness level, wherein the display coefficient is smaller than 1, and the physical brightness is included in a physical brightness range in high brightness mode of the display screen; and a controlling module configured to control the display screen to display at a target display brightness based on the obtained physical brightness and the obtained display coefficient.

In a third aspect, an embodiment of the present disclosure provides a terminal device, including: a display screen; a processor; a memory for storing instructions that can be executed by the processor to perform operations including: in response to a brightness adjustment trigger operation, determining a target brightness level of the display screen based on a current brightness level of the display screen; obtaining a corresponding physical brightness and a corresponding display coefficient based on the target brightness level, wherein the display coefficient is smaller than 1, and the physical brightness is included in a physical brightness range in high brightness mode of the display screen; and controlling the display screen to display at a target display brightness based on the obtained physical brightness and the obtained display coefficient.

In a fourth aspect, an embodiment of the present disclosure provides a readable storage medium having executable instructions stored thereon, the executable instructions are executed by a processor to implement: in response to a brightness adjustment trigger operation, determining a target brightness level of the display screen based on a current brightness level of the display screen; obtaining a corresponding physical brightness and a corresponding display coefficient based on the target brightness level, wherein the display coefficient is smaller than 1, and the physical brightness is included in a physical brightness range in high brightness mode of the display screen; and controlling the display screen to display at a target display brightness based on the obtained physical brightness and the obtained display coefficient.

It should be understood that the above general description and the following detailed description are only exemplary and explanatory, and do not limit the present disclosure.

BRIEF DESCRIPTION OF DRAWINGS

The accompanying drawings, which are incorporated in and constitute a part of this disclosure, illustrate examples consistent with the present disclosure and, together with the description, serve to explain the principles of the disclosure.

DETAILED DESCRIPTION

Figure 1:
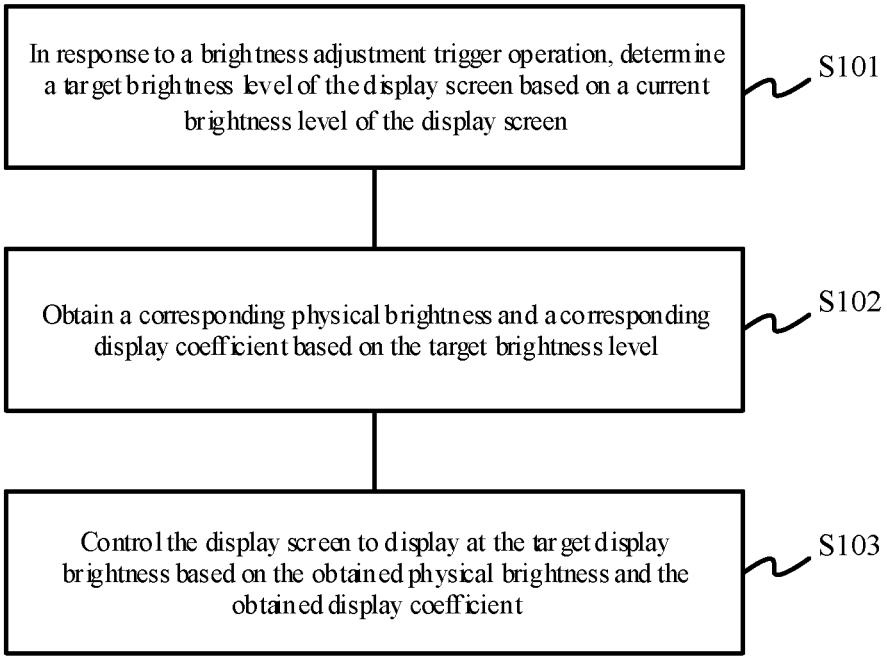
FIG. 1 is a schematic flowchart illustrating a method for adjusting brightness of a display screen according to some embodiments.

Examples will be described in detail herein, with the illustrations thereof represented in the drawings. When the following descriptions involve the drawings, like numerals in different drawings refer to like or similar elements unless otherwise indicated. The examples described in the following examples do not represent all examples consistent with the present disclosure. Rather, they are merely examples of apparatuses and methods consistent with some aspects of the present disclosure as detailed in the appended claims.

The terms used in the present disclosure are for the purpose of describing particular examples only, and are not intended to limit the present disclosure. Unless otherwise defined, the technical or scientific terms used in the present disclosure shall have the usual meanings understood by those of ordinary skill in the field to which the present disclosure belongs. The terms "a" or "an" and the like used in the specification and the claims of the present disclosure do not mean a quantity limit, but mean that there is at least one. Unless otherwise indicated, similar terms such as "include" or "comprise" mean that the elements or objects before "include" or "comprise" cover the elements or objects listed after "include" or "comprise" and their equivalents, and other elements or objects are not excluded. "Connected to" or "connected with" and similar terms are not limited to physical or mechanical connections, and can include electrical connections, whether direct or indirect. Terms determined by "a", "the" and "said" in their singular forms in the specification and the claims of the present disclosure are also intended to include plurality, unless clearly indicated otherwise in the context. It should also be understood that the term "and/or" as used herein is and includes any and all possible combinations of one or more of the associated listed items.

A brightness difference between two adjacent brightness levels of the display screen can be relatively large, resulting in that the brightness of the display screen changes significantly during a brightness adjustment process, which may affect user experience.

The display brightness of the Organic Light-Emitting Diode (OLED) display screen is related to the physical brightness and display content of the display screen. The physical brightness characterizes the overall brightness of the display screen. The display content has different brightness based on its own attributes. For example, dark display content has low brightness, and light display content has high brightness. Moreover, based on the difference in display brightness, the display screen can have display modes including a normal mode applied to low ambient light and a high brightness mode (HBM) applied to high ambient light.

In the related art, when adjusting brightness of a display screen, it is the physical brightness of the display screen in a normal mode that is actually adjusted. However, the physical brightness of the display screen can be adjusted merely on a very limited number of levels, resulting in a large brightness difference between two adjacent brightness levels. Therefore, the brightness changes significantly during the process for adjusting brightness of the display screen (especially when the brightness of the display screen is low), and the adjustment effect is not smooth, which affects the user experience.

In view of the above problems, the examples of the present disclosure provide a method and an apparatus for adjusting brightness of a display screen, and a terminal device, to mitigate the defect that the brightness adjustment effect of the display screen is not smooth.

FIG. 1 is a schematic flowchart illustrating a method for adjusting brightness of a display screen according to some embodiments. As shown in FIG. 1, the method for adjusting brightness of a display screen provided by some embodiments of the present disclosure includes step S101-S103.

S101, in response to a brightness adjustment trigger operation, a target brightness level of the display screen is determined based on a current brightness level of the display screen.

The brightness level characterizes a display brightness of a display screen, and different brightness levels correspond to different display brightness. For example, there are 2048 brightness levels, or 4096 brightness levels. A brightness adjustment trigger operation can trigger a change in the brightness level. Consecutive brightness adjustment trigger operations can trigger the brightness level to change continuously in a specific brightness level change (increasing or decreasing) direction.

Figure 2:
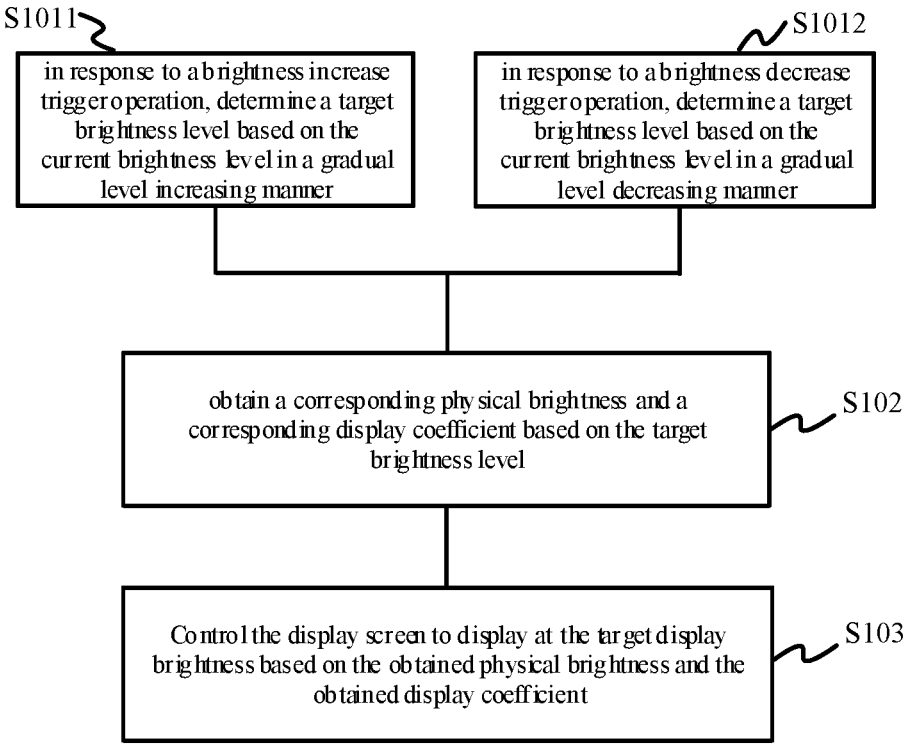
FIG. 2 is a schematic flowchart illustrating a method for adjusting brightness of a display screen according to some other embodiments.

FIG. 2 is a schematic flowchart illustrating a method for adjusting brightness of a display screen according to some other embodiments. As shown in FIG. 2, S101 can include step S1011 or step S1012.

S1011, in response to a brightness increase trigger operation, a target brightness level is determined based on the current brightness level in a gradual level increasing manner. The brightness increase trigger operation can be selected from: upward sliding operation, trigger operation on a brightness increase key (physical key or virtual key), and so on.

S1012, in response to a brightness decrease trigger operation, a target brightness level is determined based on the current brightness level in a gradual level decreasing manner. The brightness decrease trigger operation can be selected from: downward sliding operation, trigger operation on a brightness decrease key (physical key or virtual key), and so on.

S102, a corresponding physical brightness and a corresponding display coefficient are obtained based on the target brightness level.

The display coefficient is a brightness coefficient superimposed on the display content, which only affects the brightness of the display content, regardless of the physical brightness of the display screen. In addition, the display coefficient is a brightness coefficient superimposed on the entire display content without changing the specific display content.

Taking one pixel as an example, the red sub-pixel, blue sub-pixel, and green sub-pixel in the pixel are simultaneously superimposed with the display coefficient. That is, the brightness of the red sub-pixel, blue sub-pixel, and green sub-pixel in one pixel changes by the same ratio. In this way, the pixel changes the brightness while keeping the colour phase unchanged.

At S102, one brightness level corresponds to one physical brightness and one display coefficient. In some embodiments, based on a pre-stored correspondence between brightness level with physical brightness and display coefficient, a corresponding physical brightness and a corresponding display coefficient are obtained based on the target brightness level. The specific implementation of the corresponding will be described in detail in subsequent examples.

S103, the display screen is controlled to display at the target display brightness based on the obtained physical brightness and the obtained display coefficient.

The target display brightness of the display screen is a product of the physical brightness and the display coefficient. At S103, optionally, the driving current of each sub-pixel in the display screen is adjusted based on the physical brightness and the display coefficient obtained in S102, thereby causing the display screen to display at the target display brightness.

In the example of the present disclosure, the display coefficient is smaller than 1, in this way, the brightness of the display content is attenuated based on the display coefficient. The specific attenuation degree is determined by the display coefficient. The larger the display coefficient is, the more the brightness of the displayed content is attenuated.

Also, the physical brightness is included in a brightness range in high brightness mode of the display screen. For example, the physical brightness range in normal mode of the display screen is 0 nits~500 nits, the physical brightness range in high brightness mode of the display screen is 500 nits~800 nits. When a display coefficient is smaller than 1, the display coefficient is superimposed on the basis of physical brightness such that the target display brightness of the display screen can be lower than the corresponding physical brightness. Thus, the physical brightness in high brightness mode of the display screen can achieve the display brightness in the normal mode.

In some embodiments, when the physical brightness range is 500 nits to 800 nits, the display coefficient is set to 0.625. At this time, the target display brightness range of the display screen is 315 nits~500 nits. In this way, the full physical brightness range in high brightness mode can be adjusted to be included in that in a normal mode.

In this way, a physical brightness ranged originally used in the high brightness mode is included in a brightness adjustment range of the display screen to increase the number of adjustable physical brightness levels. For a display screen with the same display brightness variation range, according to the examples of the present disclosure, compared with the related art, the variation range may correspond to more brightness levels. Thus, in the process of brightness adjustment, the brightness difference between the brightness levels of adjacent orders (hereinafter can also be referred to simply as "the brightness difference between adjacent orders") can be smaller. Based on this, the method for adjusting brightness of a display screen provided by the examples of the present disclosure can achieve a more delicate and smooth brightness change effect, and optimize the user experience.

There are various implementations for the pre-stored correspondence between brightness level with physical brightness and display coefficient at S102, which will be described in detail below with specific examples.

The display screen has a plurality of registers to store different kinds of data. The control chip of the display screen reads the data in the registers to control the drive circuit to output the drive current, and then controls the pixels to enable image display. The physical brightness and the display coefficients are stored in respective registers. Therefore, when the brightness of the display screen changes rapidly, there can be a time difference between the control chip reading the data of the physical brightness and the display coefficient, resulting in a time difference between the influence of the physical brightness and the display coefficient on the brightness of the display screen, that is, a problem that the display screen flickers.

In view of this, in the example of the present disclosure, the correspondence between brightness level with physical brightness and display coefficient is configured such that: corresponding to different brightness levels, the physical brightness or the display coefficient is a fixed value. In this way, the physical brightness and the display coefficients won't have to synchronously change. It can effectively avoid the occurrence of flickering during the brightness adjustment process, guarantee the adjustment effect, and optimize the user experience.

In one example, Table 1 is a table of the correspondence shown according to some embodiments.

TABLE 1

| Brightness level | Physical brightness (nits) | Display coefficient | Display brightness (nits) |
|---|---|---|---|
| 22 | 7.327797 | 0.3305 | 2.421837 |
| 23 | 7.572057 | 0.3305 | 2.502565 |
| 24 | 7.816317 | 0.3305 | 2.583293 |
| 25 | 8.060576 | 0.3305 | 2.664021 |
| 26 | 8.304836 | 0.3305 | 2.744748 |
| 27 | 8.549096 | 0.3305 | 2.825476 |
| 28 | 8.793356 | 0.3305 | 2.906204 |
| 29 | 9.037616 | 0.3305 | 2.986932 |
| 30 | 9.281876 | 0.3305 | 3.067660 |
| 31 | 9.526136 | 0.3305 | 3.148388 |
| 32 | 9.770396 | 0.3305 | 3.229116 |

In this example, the correspondence between brightness level with physical brightness and display coefficient is configured such that: for a first brightness level and a second brightness level which is adjacent to and higher than the first brightness level, the first brightness level corresponds to a first physical brightness and a first display coefficient, and the second brightness level corresponds to a second physical brightness and a second display coefficient; the first physical brightness is smaller than the second physical brightness, and the first display coefficient is the same as the second display coefficient.

As shown in Table 1, brightness levels 22 to 32 correspond to the same display coefficient, but each corresponds to a different physical brightness. Through different physical brightness, the display brightness (that is, the target display brightness in the adjustment process) corresponding to different brightness levels is changed.

In some embodiments, as shown in Table 1, as the brightness level increases, the corresponding physical brightness increases in such a manner that the different between any two adjacent physical brightness is fixed. In this way, the brightness of the display screen is uniformly changed during the brightness adjustment process to optimize the user experience.

In some embodiments, as the brightness level increases, the difference between the corresponding physical brightness can vary. For example, when the brightness level is lower than a preset level, the difference between physical brightness corresponding to any two adjacent brightness levels is a first difference; and when the brightness level is higher than the preset level, the difference between physical brightness corresponding to any two adjacent brightness levels is a second difference, and the first difference can be smaller than the second difference.

In this way, when the brightness of the display screen is low, the brightness changes between adjacent orders in the brightness adjustment process are smoother, avoiding obvious brightness fluctuations observable by the user and thus optimizing the user experience.

In one example, Table 2 is a table of a correspondence shown according to some embodiments.

TABLE 2

| Brightness level | Physical brightness (nits) | Display coefficient | Display brightness (nits) |
|---|---|---|---|
| 8 | 7.327797 | 0.2745 | 2.011480 |
| 9 | 7.327797 | 0.2785 | 2.040791 |
| 10 | 7.327797 | 0.2825 | 2.070103 |
| 11 | 7.327797 | 0.2865 | 2.099414 |
| 12 | 7.327797 | 0.2905 | 2.128725 |
| 13 | 7.327797 | 0.2945 | 2.158036 |
| 14 | 7.327797 | 0.2985 | 2.187347 |
| 15 | 7.327797 | 0.3025 | 2.216659 |
| 16 | 7.327797 | 0.3065 | 2.245970 |
| 17 | 7.327797 | 0.3105 | 2.275281 |
| 18 | 7.327797 | 0.3145 | 2.304592 |

In this example, the correspondence between brightness level with physical brightness and display coefficient is configured such that: for a first brightness level and a second brightness level which is adjacent to and higher than the first brightness level, the first brightness level corresponds to a first physical brightness and a first display coefficient, and the second brightness level corresponds to a second physical brightness and a second display coefficient; the first physical brightness is the same as the second physical brightness, and the first display coefficient is smaller than the second display coefficient.

As shown in Table 2, brightness levels 8 to 18 correspond to the same physical brightness, but each corresponds to a different display coefficient. Through different display coefficients, the actual display brightness (that is, the target display brightness in the adjustment process) corresponding to different brightness levels is changed.

In some embodiments, as shown in Table 2, as the brightness level increases, the corresponding display coefficient increases in such a manner that the different between any two adjacent display coefficients is fixed. In this way, the brightness of the display screen is uniformly changed during the brightness adjustment process, and the user experience is optimized.

In some embodiments, as the brightness level increases, the difference between the corresponding display coefficients can vary. For example, when the brightness level is lower than a preset level, the difference between display coefficients corresponding to any two adjacent brightness levels is a first difference; and when the brightness level is higher than the preset level, the difference between display coefficients corresponding to any two adjacent brightness levels is the second difference, and the first difference can be smaller than the second difference.

In this way, when the brightness of the display is low, the brightness changes between adjacent orders in the brightness adjustment process are smoother, avoiding obvious brightness fluctuations observable by the user and thus optimizing the user experience.

It should be noted that since the display coefficient is smaller than 1, the method of changing the display coefficient and fixing the physical brightness can further reduce the brightness difference between brightness levels of adjacent orders, and further ensure that the display brightness changes smoothly.

In some embodiments, the correspondence between brightness level with physical brightness and display coefficient is configured such that: when the brightness level is lower than a preset level, the display coefficient corresponding to the brightness level increases as the brightness level increases while the physical brightness corresponding to the brightness level is a fixed value. In this way, when the display brightness is low, the display brightness can smoothly change, the smoothness of brightness adjustment can be improved, and the user experience can be optimized.

In addition, when the brightness level is higher than or equal to the preset level, the physical brightness corresponding to the brightness level increases as the brightness level increases while the display coefficient corresponding to the brightness level is a fixed value.

Compared with the way of fixing the physical brightness and changing the display coefficient, the brightness difference between brightness levels of adjacent orders in this way increases. At this time, the display brightness of the display screen is increased, so increasing the brightness difference between brightness levels of adjacent orders will not cause the user to observe obvious brightness fluctuations, thereby improving the adjustment efficiency and quickly reaching the target display brightness.

Table 3 is a table of a correspondence shown according to some embodiments.

TABLE 3

| Brightness level | Physical brightness (nits) | Display coefficient | Display brightness (nits) | Brightness difference between adjacent orders (nits) |
|---|---|---|---|---|
| 18 | 7.327797 | 0.3145 | 2.304592 | |
| 19 | 7.327797 | 0.3185 | 2.333903 | 0.029311 |
| 20 | 7.327797 | 0.3225 | 2.363214 | 0.029311 |
| 21 | 7.327797 | 0.3265 | 2.392526 | 0.029311 |
| 22 | 7.327797 | 0.3305 | 2.421837 | 0.029311 |
| 23 | 7.572057 | 0.3305 | 2.502565 | 0.080728 |
| 24 | 7.816317 | 0.3305 | 2.583293 | 0.080728 |
| 25 | 8.060576 | 0.3305 | 2.664021 | 0.080728 |
| 26 | 8.304836 | 0.3305 | 2.744748 | 0.080728 |
| 27 | 8.549096 | 0.3305 | 2.825476 | 0.080728 |
| 28 | 8.793356 | 0.3305 | 2.906204 | 0.080728 |

As shown in Table 3, brightness levels 18 to 22 correspond to the same physical brightness, and each corresponds to a different display coefficient; brightness levels 23 to 28 correspond to the same display coefficient, and each corresponds to a different physical brightness. In this way, the brightness difference between adjacent orders in the brightness levels 18 to 22 (the display brightness is low) is smaller than that in the brightness levels 23 to 28 (the display brightness is high). Apparently, by adjusting the display coefficient to reduce the brightness difference between brightness levels of adjacent orders, when the brightness is low, it can further ensure the smooth and delicate change of brightness during the brightness adjustment process.

Of course, under the condition that one of the physical brightness and the display coefficient is fixed and the other is changed, the corresponding can also be implemented in other ways, and the examples of the present disclosure do not specifically limit it.

Figure 3:
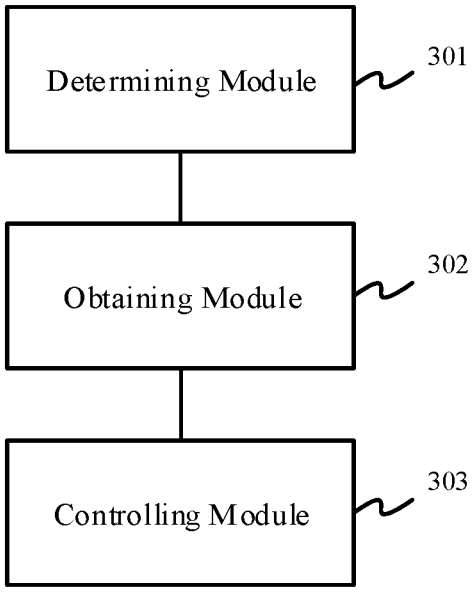
FIG. 3 is a block diagram illustrating an apparatus for adjusting brightness of a display screen according to some embodiments.
Figure 4:
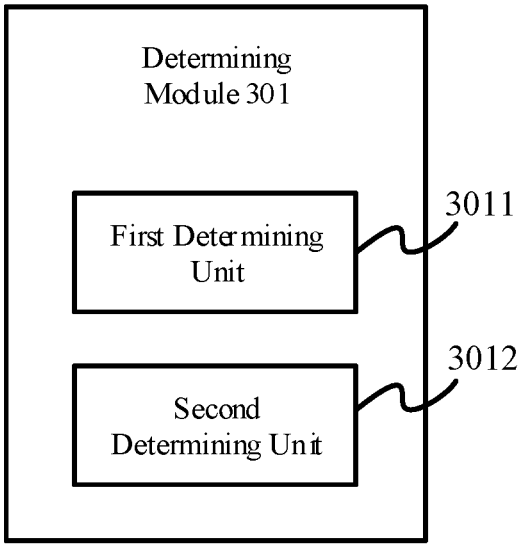
FIG. 4 is a block diagram illustrating an apparatus for adjusting brightness of a display screen according to some other embodiments.

In a second aspect, some embodiments of the present disclosure also provide an apparatus suitable for the method for adjusting brightness of a display screen provided in the first aspect. FIGS. 3 to 4 are apparatuses for adjusting brightness of a display screen provided according to different examples.

As shown in FIG. 3, the apparatuses of adjusting brightness of a display screen includes:

a determining module 301 configured to, in response to a brightness adjustment trigger operation, determine a target brightness level of the display screen based on a current brightness level of the display screen;

an obtaining module 302 configured to obtain a corresponding physical brightness and a corresponding display coefficient based on the target brightness level, wherein the display coefficient is smaller than 1, and the physical brightness is included in a physical brightness range in high brightness mode of the display screen; and a controlling module 303 configured to control the display screen to display at a target display brightness based on the obtained physical brightness and the obtained display coefficient.

In some embodiments, the obtaining module 302 is specifically configured to, based on a pre-stored correspondence between brightness level with physical brightness and display coefficient, obtain a corresponding physical brightness and a corresponding display coefficient based on the target brightness level.

In some embodiments, the correspondence between brightness level with physical brightness and display coefficients is configured such that: for a first brightness level and a second brightness level which is adjacent to and higher than the first brightness level, the first brightness level corresponds to a first physical brightness and a first display coefficient, and the second brightness level corresponds to a second physical brightness and a second display coefficient; the first physical brightness is smaller than the second physical brightness, and the first display coefficient is the same as the second display coefficient In some embodiments, the correspondence between brightness level with physical brightness and display coefficient is configured such that: for a first brightness level and a second brightness level which is adjacent to and higher than the first brightness level, the first brightness level corresponds to a first physical brightness and a first display coefficient, and the second brightness level corresponds to a second physical brightness and a second display coefficient; the first physical brightness is the same as the second physical brightness, and the first display coefficient is smaller than the second display coefficient.

In some embodiments, when the brightness level is lower than a preset level, the display coefficient corresponding to the brightness level increases as the brightness level increases while the physical brightness corresponding to the brightness level a is fixed value.

In some embodiments, as shown in FIG. 4, the determining module 301 includes:

a first determining unit 3011 configured to, in response to a brightness increase trigger operation, determine the target brightness level based on the current brightness level in a gradual level increasing manner; and a second determining unit 3012 configured to, in response to a brightness decrease trigger operation, determine the target brightness level based on the current brightness level in a gradual level decreasing manner.

In some embodiments, the physical brightness range in high brightness mode of the display screen is 500 nits to 800 nits; when the physical brightness is larger than 500 nits, the display coefficient is set to 0.625.

Some embodiments of the present disclosure provide a terminal device that can apply the method for adjusting brightness of a display screen provided by the above example. In some embodiments, the terminal device is selected from: a mobile phone, a tablet computer, a wearable device (smart watch, smart bracelet, etc.), an in-vehicle device, or a medical device.

Figure 5:
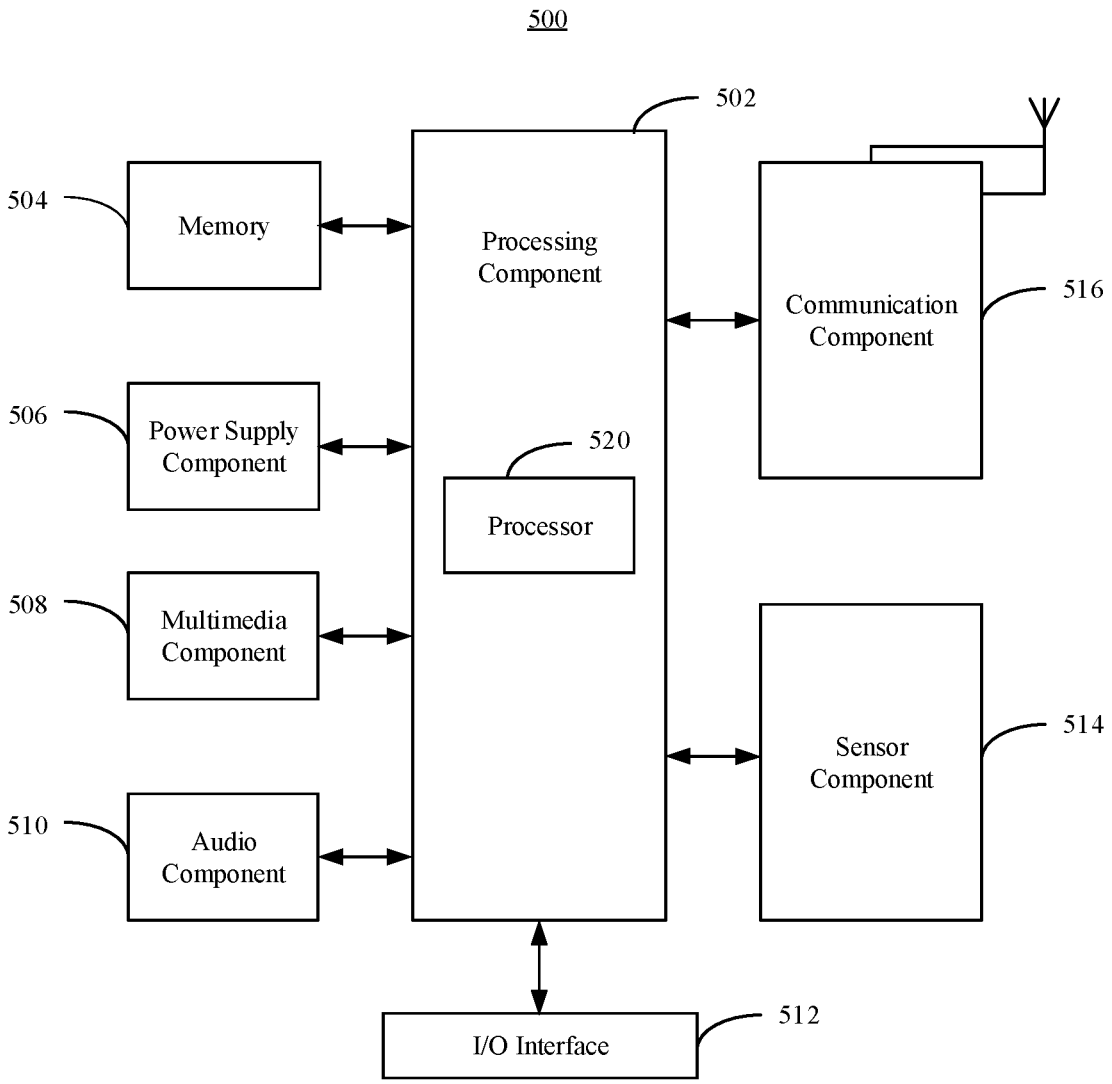
FIG. 5 is a block diagram illustrating a terminal device according to some embodiments.

FIG. 5 is a block diagram illustrating a terminal device according to some embodiments. As shown in FIG. 5, the terminal device 500 can include one or more of the following components: a processing component 502, a memory 504, a power supply component 506, a multimedia component 508, an audio component 510, an input/output (I/O) interface 512, a sensor component 514, a communication component 516 and an image capturing component.

The processing component 502 generally controls overall operations of the terminal device 500, such as operations associated with display, phone calls, data communications, camera operations, and recording operations. The processing component 502 can include one or more processors 520 to execute instructions. In addition, the processing component 502 can include one or more modules which facilitate the interaction between the processing component 502 and other components. For example, the processing component 502 can include a multimedia module to facilitate the interaction between the multimedia component 508 and the processing component 502.

The memory 504 is to store various types of data to support the operation of the terminal device 500. Examples of such data include instructions for any application or method operated on the terminal device 500, contact data, phonebook data, messages, pictures, videos, and so on. The memory 504 can be implemented by any type of volatile or non-volatile storage devices or a combination thereof, such as a Static Random Access Memory (SRAM), an Electrically Erasable Programmable Read-Only Memory (EEPROM), an Erasable Programmable Read-Only Memory (EPROM), a Programmable Read-Only Memory (PROM), a Read-Only Memory (ROM), a magnetic memory, a flash memory, a magnetic or compact disk.

The power supply component 506 supplies power for different components of the terminal device 500. The power supply component 506 can include a power supply management system, one or more power supplies, and other components associated with generating, managing and distributing power for the terminal device 500.

The multimedia component 508 includes a screen providing an output interface between the terminal device 500 and a target object. In some examples, the screen can include a Liquid Crystal Display (LCD) screen and a Touch Panel (TP). In some embodiments, an organic light-emitting diode (OLED) display or other types of displays can be employed.

If the screen includes the TP, the screen can be implemented as a touch screen to receive input signals from the target object. The TP can include one or more touch sensors to sense touches, swipes, and gestures on the TP. The touch sensors can not only sense a boundary of a touch or swipe, but also sense a duration and a pressure associated with the touch or swipe.

The audio component 510 is to output and/or input an audio signal. For example, the audio component 510 includes a microphone (MIC). When the terminal device 500 is in an operating mode, such as a call mode, a record mode and a voice recognition mode, the microphone is to receive an external audio signal. The received audio signal can be further stored in the memory 504 or sent via the communication component 516. In some examples, the audio component 510 further includes a speaker for outputting an audio signal.

The I/O interface 512 provides an interface between the processing component 502 and a peripheral interface module. The above peripheral interface module can be a keyboard, a click wheel, buttons, or the like.

The sensor component 514 includes one or more sensors to provide status assessments of various aspects for the terminal device 500. For example, the sensor component 514 can detect the on/off status of the terminal device 500, and relative positioning of component, for example, the component is a display screen and a keypad of the terminal device 500. The sensor component 514 can also detect a change in position of the terminal device 500 or a component of the terminal device 500, a presence or absence of the contact between a target object and the terminal device 500, an orientation or an acceleration/deceleration of the terminal device 500, and a change in temperature of the terminal device 500. For example, the sensor component 514 can further include an optical sensor disposed below the OLED display screen.

The communication component 516 is to facilitate wired or wireless communication between the terminal device 500 and other devices. The terminal device 500 can access a wireless network based on a communication standard, such as Wi-Fi, 2G, 3G, 4G, 5G, or a combination thereof. In some embodiments, the communication component 516 receives a broadcast signal or broadcast related information from an external broadcast management system via a broadcast channel. In some embodiments, the communication component 516 can further include a Near Field Communication (NFC) module for promoting short-range communication. For example, the NFC module can be implemented based on a radio frequency identification (RFID) technology, an infrared data association (IrDA) technology, an ultra-wideband (UWB) technology, a Bluetooth (BT) technology and other technologies.

In some embodiments, the terminal device 500 can be implemented by one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, microcontrollers, microprocessors, or other electronic components.

In some embodiments, a non-transitory computer-readable storage medium is also provided, which stores processing-circuit-executable instructions. The executable instructions can be executed by the processor of the terminal device to implement the steps of the method for adjusting brightness of a display screen provided above. The readable storage medium can be a Read-Only Memory (ROM), a Random-Access Memory (RAM), a CD-ROM, a magnetic tape, a floppy disk, an optical data storage device, and so on.

The methods and the apparatuses for adjusting brightness of a display screen, and the terminal device provided by embodiments of the present disclosure can have one or more of the following advantages.

During the brightness adjustment process, the display brightness corresponding to the physical brightness in the high brightness mode is reduced based on a display coefficient smaller than 1, such that the physical brightness range originally applied in the high brightness mode is included in the brightness adjustment range. In this way, the number of adjustable physical brightness levels of the display screen in the normal mode can be increased, and the brightness difference between brightness levels of adjacent orders can be reduced. The method for adjusting brightness of a display screen provided by the embodiments of the present disclosure can achieve a more delicate and smooth brightness change effect, and optimize the user experience.

One of ordinary skill in the art will understand that the above described modules/units can each be implemented by hardware, or software, or a combination of hardware and software. One of ordinary skill in the art will also understand that multiple ones of the above described modules/units may be combined as one module/unit, and each of the above described modules/units may be further divided into a plurality of sub-modules/sub-units.

The various device components, modules, units, blocks, or portions may have modular configurations, or are composed of discrete components, but nonetheless can be referred to as "modules" in general. In other words, the "components," modules," "blocks," "portions," or "units" referred to herein may or may not be in modular forms, and these phrases may be interchangeably used.

In the present disclosure, the terms "installed," "connected," "coupled," "fixed" and the like shall be understood broadly, and can be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, which is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium can be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

A computer program (also known as a program, software, software application, app, script, or code) can be written in any form of programming language, including compiled or interpreted languages, declarative or procedural languages, and it can be deployed in any form, including as a stand-alone program or as a portion, component, subroutine, object, or other portion suitable for use in a computing environment. A computer program can, but need not, correspond to a file in a file system. A program can be stored in a portion of a file that holds other programs or data (e.g., one or more scripts stored in a mark-up language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HMD) device, a head-up display (HUD) device, smart eyewear (e.g., glasses), a CRT (cathode-ray tube), LCD (liquid-crystal display), OLED (organic light emitting diode), or any other monitor for displaying information to the user and a keyboard, a pointing device, e.g., a mouse, trackball, etc., or a touch screen, touch pad, etc., by which the user can provide input to the computer.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components.

The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It should be understood that "a plurality" or "multiple" as referred to herein means two or more. "And/or," describing the association relationship of the associated objects, indicates that there may be three relationships, for example, A and/or B may indicate that there are three cases where A exists separately, A and B exist at the same time, and B exists separately. The character "/" generally indicates that the contextual objects are in an "or" relationship.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

What is claimed is:

1. A method of adjusting display brightness of a display screen of a terminal device, comprising:

in response to a brightness increase trigger operation, determining a target brightness level of the display screen based on a current brightness level of the display screen in a gradual level increasing manner; or in response to a brightness decrease trigger operation, determining the target brightness level base on the current brightness level in a gradual level decreasing manner;

based on a pre-stored correspondence between a brightness level with a physical brightness and a display coefficient, obtaining a corresponding physical brightness and a corresponding display coefficient based on the target brightness level, wherein the display coefficient is smaller than 1, the physical brightness characterizes display brightness of the display screen when displaying white display content and is included in a physical brightness range in high brightness mode of the display screen, and the correspondence is configured such that; corresponding to different brightness levels, the physical brightness or the display coefficient is a fixed value; and controlling the display screen to display at a target display brightness based on the obtained physical brightness and the obtained display coefficient.

2. The method according to claim 1, wherein the target display brightness is a product of the obtained physical brightness and the obtained display coefficient.

3. The method according to claim 1, wherein the correspondence is configured such that:

for a first brightness level and a second brightness level which is adjacent to and higher than the first brightness level, the first brightness level corresponds to a first physical brightness and a first display coefficient, and the second brightness level corresponds to a second physical brightness and a second display coefficient;

the first physical brightness is smaller than the second physical brightness, and the first display coefficient is the same as the second display coefficient.

4. The method according to claim 3, wherein the correspondence is further configured such that:

a difference between the first physical brightness and the second physical brightness does not change as the brightness level increases.

5. The method according to claim 1, wherein the correspondence is configured such that:

for a first brightness level and a second brightness level which is adjacent to and higher than the first brightness level, the first brightness level corresponds to a first physical brightness and a first display coefficient, and the second brightness level corresponds to a second physical brightness and a second display coefficient;

the first physical brightness is the same as the second physical brightness, and the first display coefficient is smaller than the second display coefficient.

6. The method according to claim 5, wherein the correspondence is further configured such that:

when the brightness level is lower than a preset level, the display coefficient corresponding to the brightness level increases as the brightness level increases while the physical brightness corresponding to the brightness level is a fixed value.

7. The method according to claim 6, wherein the correspondence is further configured such that:

when the brightness level is higher than or equal to the preset level, the physical brightness corresponding to the brightness level increases as the brightness level increases while the display coefficient corresponding to the brightness level is a fixed value.

8. The method according to claim 5, wherein the correspondence is further configured such that:

a difference between the first display coefficient and the second display coefficient does not change as the brightness level increases.

9. The method according to claim 1, wherein the physical brightness range in high brightness mode of the display screen is 500 nits to 800 nits;

when the physical brightness is larger than 500 nits, the display coefficient is set to 0.625.

10. A terminal device, comprising:

a display screen;

a processor; and memory for storing instructions executable by the processor to perform operations comprising:

in response to a brightness increase trigger operation, determining a target brightness level of the display screen based on a current brightness level of the display screen in a gradual level increasing manner; or in response to a brightness decrease trigger operation, determining the target brightness level based on the current brightness level in a gradual level decreasing manner;

based on a pre-stored correspondence between brightness level with physical brightness and display coefficient, obtaining a corresponding physical brightness and a corresponding display coefficient based on the target brightness level, wherein the display coefficient is smaller than 1, the physical brightness characterizes display brightness of the display screen when displaying white display content and is included in a physical brightness range in high brightness mode of the display screen, and the correspondence is configured such that: corresponding to different brightness level, the physical brightness or the display coefficient is a fixed value; and controlling the display screen to display at a target display brightness based on the obtained physical brightness and the obtained display coefficient.

11. The terminal device according to claim 10, wherein the target display brightness is a product of the obtained physical brightness and the obtained display coefficient.

12. The terminal device according to claim 10, wherein the correspondence is configured such that:

for a first brightness level and a second brightness level which is adjacent to and higher than the first brightness level, the first brightness level corresponds to a first physical brightness and a first display coefficient, and the second brightness level corresponds to a second physical brightness and a second display coefficient;

the first physical brightness is smaller than the second physical brightness, and the first display coefficient is the same as the second display coefficient.

13. The terminal device according to claim 10, wherein the correspondence is configured such that:

for a first brightness level and a second brightness level which is adjacent to and higher than the first brightness level, the first brightness level corresponds to a first physical brightness and a first display coefficient, and the second brightness level corresponds to a second physical brightness and a second display coefficient;

the first physical brightness is the same as the second physical brightness, and the first display coefficient is smaller than the second display coefficient.

14. The terminal device according to claim 13, wherein the correspondence is further configured such that:

when the brightness level is lower than a preset level, the display coefficient corresponding to the brightness level increases as the brightness level increases while the physical brightness corresponding to the brightness level is a fixed value.

15. The terminal device according to claim 14, wherein the correspondence is further configured such that:

when the brightness level is higher than or equal to the preset level, the physical brightness corresponding to the brightness level increases as the brightness level increases while the display coefficient corresponding to the brightness level is a fixed value.

16. A non-transitory computer-readable storage medium having executable instructions stored thereon, wherein the executable instructions are executed by a processor to implement:

in response to a brightness increase trigger operation, determining a target brightness level of a display screen of a terminal device based on a current brightness level of the display screen in a gradual level increasing manner; or in response to a brightness decrease trigger operation, determining the target brightness level based on the current brightness level in a gradual level decreasing manner;

based on a pre-stored correspondence between brightness level with physical brightness and display coefficient, obtaining a corresponding physical brightness and a corresponding display coefficient based on the target brightness level, wherein the display coefficient is smaller than 1, the physical brightness characterizes display brightness of the display screen when displaying white display content and is included in a physical brightness range in high brightness mode of the display screen, and the correspondence is configured such that: corresponding to different brightness levels, the physical brightness or the display coefficient is a fixed value; and controlling the display screen to display at a target display brightness based on the obtained physical brightness and the obtained display coefficient.

* * * * *